United States Patent [19]

Campbell et al.

[11] 4,228,413

[45] Oct. 14, 1980

[54] SADDLE-TOROID DEFLECTION WINDING FOR LOW LOSS AND/OR REDUCED CONDUCTOR LENGTH

[75] Inventors: Francis J. Campbell, Yardley, Pa.; William H. Barkow, Pennsauken, N.J.

[73] Assignee: RCA Corporation, New York, N.Y.

[21] Appl. No.: 968,417

[22] Filed: Dec. 11, 1978

[51] Int. Cl.[3] ..... H01F 5/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 2,925,542 | 2/1960 | Gethmann | 335/213 |
| 3,735,193 | 5/1973 | Ikeuchi | 335/213 |
| 3,895,329 | 7/1975 | Logan et al. | 335/210 |
| 4,023,129 | 5/1977 | Kratz et al. | 335/210 |
| 4,117,432 | 9/1978 | Shizu | 335/210 |
| 4,128,824 | 12/1978 | Mirsch | 335/213 |

*Primary Examiner*—George Harris

*Attorney, Agent, or Firm*—Eugene M. Whitacre; William H. Meise; Scott J. Stevens

[57] ABSTRACT

A deflection yoke for deflecting the electron beam of a kinescope includes conductors, portions of which are saddle-wound and portions of which are toroidally wound for reducing the length of conductor required for deflection, for reducing losses due to leakage fields, or both.

2 Claims, 6 Drawing Figures

SADDLE-TOROID DEFLECTION WINDING FOR LOW LOSS AND/OR REDUCED CONDUCTOR LENGTH

BACKGROUND OF THE INVENTION

This invention relates to deflection windings including both saddle-wound and toroidally-wound portions for deflecting an electron beam to form a line on the screen of the kinescope.

Television displays are ordinarily formed on the lighted raster area on the screen of a kinescope. The raster is formed by repetitively scanning one or more electron beams over the phosphor-coated screen. The repetitive scanning is accomplished by high-speed scanning along horizontal lines, together with a relatively slow-speed scanning in a vertical direction. The deflection of the electron beams in broadcast television receivers is by means of deflection windings through which the appropriate deflection current flows. A deflection yoke for a kinescope may include a pair of windings adapted for horizontal deflection, a further pair of windings adapted for vertical deflection, an annular or toroidal magnetic core, and may also include ancillary windings for correcting the various distortions which occur in the formation of the raster. Such ancillary windings may include dynamic convergence and quadrature windings.

Energy is stored in magnetic fields produced by the deflection windings. In order to conserve energy and reduce power consumption, the energy is recirculated through the deflection circuit associated with the winding. The deflection circuit and the deflection winding have resistance, and the resistance causes a portion of the energy being circulated to be lost as heat. In the case of horizontal deflection, recirculation occurs about 15,750 times each second, and reduction of the losses is of paramount concern. Thus, the horizontal deflection windings in the prior art are often configured as saddle windings. Saddle windings have less leakage fields than the equivalent toroidal winding, resulting in less energy stored in the magnetic field of the windings during each deflection cycle and consequently less recirculation loss.

The vertical deflection windings in the prior art may be configured as either saddle or toroid windings. Toroidal windings may have the advantage of shorter conductor length than the equivalent saddle winding, and allow precision conductor placement.

In the highly competitive commercial television field, cost considerations make the shorter conductor length of the toroidal winding very desirable. Even though the stored energy is higher, toroidal vertical deflection windings are often used, since the stored energy is recirculated only 60 times a second, and the dissipative losses are commensurately smaller than at the higher horizontal frequency. Also, the shorter conductor length of the toroidal winding reduces the resistance of the deflection winding, thereby mitigating the losses resulting from the increased leakage fields. Windings having conductor lengths less than those of a saddle winding and leakage less than those of a toroid winding might be advantageous for both horizontal and vertical use.

SUMMARY OF THE INVENTION

A deflection yoke adapted for deflection of an electron beam of a kinescope includes a deflection winding arrangement with first and second winding portions lying along the inner surface of a magnetically permeable annular core for producing a field upon the passage of a deflection current through the winding arrangement for deflecting the electron beam in a line, the winding arrangement further comprising first return conductors disposed at the entrance and exit ends of the core and associated with the first winding portion to form saddle windings, the winding arrangement also comprising second return conductors girdling the core and associated with the second winding portions to form toroidal windings.

DESCRIPTION OF THE INVENTION

Figure 1:
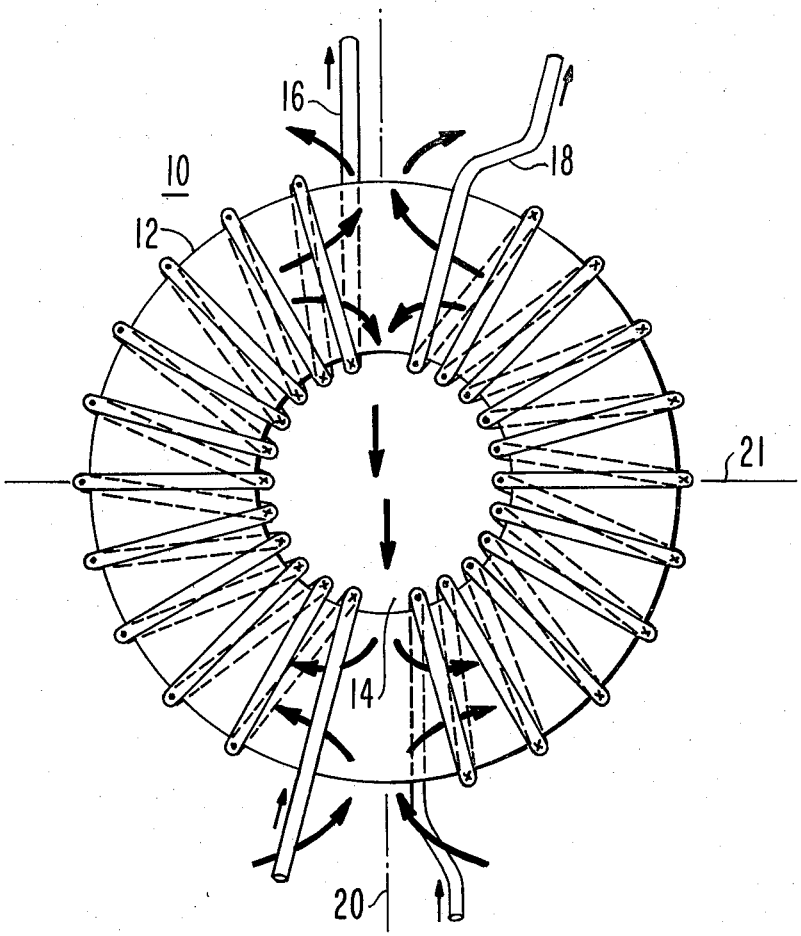
PRIOR ART Fig. 1.
FIG. 1 illustrates a toroidally wound yoke according to the prior art and its gross magnetic field distribution.

In FIG. 1, a deflection yoke 10 includes a generally annular magnetic core 12 having a central aperture 14. The core is girdled by conductors 16 and 18 which are toroidally wound about the core on either side of an axis of symmetry 20. For the indicated direction of conventional current flow in the conductors, the portions of winding 16 adjacent center aperture 14 have current flow perpendicular to the page and inwardly directed. The inward direction is illustrated in FIG. 1 by the letter X associated with each winding. Similarly, those portions of conductor 16 lying along the outer periphery of core 12 have conventional current flow out from the plane of the page, as indicated by the associated dots. As indicated by the dots and letters X associated with conductor 18, conventional current flow in conductor 18 is out of the page along the inner periphery of the core and into the page at the outer periphery. These directions of current flow produce magnetic fields within core 12 in the directions indicated by the heavy arrows. At the top and at the bottom of yoke 10, the magnetic fields produced by conductors 16 and 18 oppose, thereby creating a downwardly-directed magnetic field within central aperture 14 and leakage flux away from the central aperture, also as indicated by the heavy arrows. For the indicated direction of magnetic field in aperture 14, an electron beam passing through the aperture is deflected to form a line on the screen of the kinescope in the direction of line 21.

Figure 2:
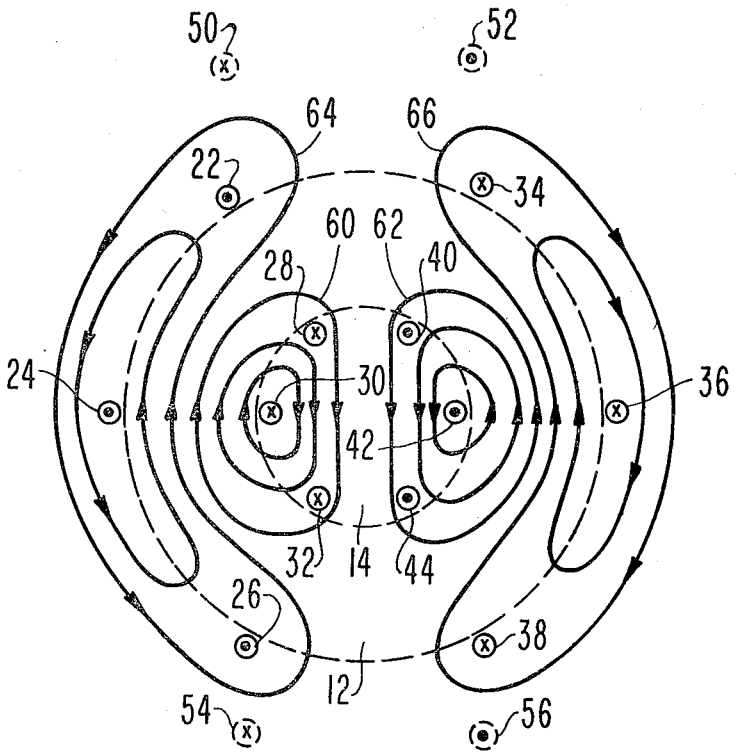
PRIOR ART Fig. 2.
FIG. 2 illustrates in more detail the magnetic field distribution of the yoke of FIG. 1; and FIG. *3a–d* illustrates in semipictorial form three views of a deflection yoke winding according to the invention together with the magnetic field associated therewith.

FIG. 2 illustrates in more detail the magnetic field structure produced by windings such as those of FIG. 1 at a cross-section of the yoke. In FIG. 2, circles 22 through 32 are representative of portions of conductor 16 lying along the inner and outer peripheries of core 12. Similarly, circles 34 through 44 represent conductor 18. The arrangement of FIG. 2 is symmetric about vertical and horizontal axes, and the explanation of effects in the upper half of FIG. 2 is equally applicable to the lower half. In FIG. 2, it can be seen that the turn of conductor 16 represented by 22 and 28 produces a magnetic field represented as magnetic line 60, which opposes the corresponding magnetic field line 62 produced by end turn 34, 40 of conductor 18. As a result of this opposition, field lines 60 and 62 may be thought of as spilling over or leaving the magnetic core and passing vertically downward through aperture 14 to reenter the core near corresponding winding turns 26, 32 and 38, 44 of conductors 16 and 18, respectively. Conductor turns 22, 28 and 34, 40 also produce magnetic field lines such as 64 and 66, respectively, which also oppose within the core. Field lines 64 and 66 may be thought of as leaving the outer periphery of the core and closing upon themselves along a path extending outside the core and through winding turns 26, 32 and 38, 44, respectively. The portion of the magnetic field produced by conductors 16 and 18 which does not pass through central aperture 14 cannot affect the electron beam and does not contribute to deflection. Consequently, the portion of the magnetic field produced by conductors 16 and 18 as represented by field lines 64 and 66 represents stray fields which contribute to undesired energy storage in the deflection yoke.

As is known, only the current distribution along the inner surface of the yoke is effective in producing deflection fields. The exact shape of the current distribution on the inner surface determines the characteristics of the deflection field such as convergence, pincushion and the like. Thus, the deflection is almost independent of the direction of current flow along the outer periphery of the core. One might therefore view the field lines such as 64, 66 associated with the leakage fields as being generated by a turn of conductor 22, 34 which is independent of turn 28, 40. With this viewpoint, one can further imagine a turn of wire such as 50, 52 (illustrated in phantom view) associated with conductors 22 and 34 in such a manner as to cancel the field represented by lines 64 and 66 without affecting the useful field represented by lines 60 and 62 within central aperture 14. The addition of a turn 50, 52 of conductor proximate conductors 22 and 34 results in a negation of the effect of the current flow in conductors 22 and 34. With this view, conductor portions 52 and 34 along the outer periphery of the core need not exist, with the result that the undesirable external field which they contribute must flow elsewhere, preferably through central aperture 14. Similarly, a turn 54, 56 at the bottom of the yoke conceptually negates the fringing field produced by conductors 26 and 38 and renders conductors 26 and 38 unnecessary.

FIG. 3 illustrates a winding arrangement by which a portion of the external field is eliminated and at the same time the field within the inner aperture is enhanced. This is accomplished by maintaining the same current distribution along the inner surface of the core while modifying the current distribution along the outer surface. In FIG. 3, a yoke 310 includes a magnetic core 312 and associated conductors 316 and 318. In FIG. 3*a*, yoke 310 is viewed from the large beam-exit end. FIGS. 3*b* and 3*c* are side and bottom views of yoke 310, respectively.

In FIG. 3, it can be seen that conductors 316 and 318 are wound about core 312 in a manner which is skew-symmetric with respect to a plane 392 passing through the axis of the yoke. The yoke is also symmetric about a vertical plane 383 passing through the axis. The winding of conductor 318 begins at a point 320 at the beam-entrance end of the yoke, and proceeds along the inner surface of the yoke to a point 322 at the beam-exit end. From point 322, the conductor returns along the outer periphery of the yoke to a point 323. From point 323, conductor 318 is wound along the inner surface of the yoke to a point 324 at the exit end, thus girdling core 312 to form a toroidal turn. From point 324, conductor 318 continues to be toroidally wound past points 326, 328, 330, and 332 to a point 334 at the beam-exit end. From point 334, conductor 318 is routed in the fashion of an end turn of a saddle winding along the exit-end circumference of the core to a point 336 on the vertical axis of the yoke. From point 336, conductor 318 is routed to an exit-end point 337, thence along the inner surface of the core to the entrance end of the yoke and circumferentially at the entrance end of the yoke past a point 338 to form a saddle type winding. Winding continues through points 340 through 349 to form a saddle winding much as that described in U.S. Pat. No. 3,895,329 in the name of Logan, et al. issued on July 15, 1975 and U.S. Pat. No. 4,023,129 in the name of Kratz, et al. issued on May 10, 1977. Winding 318 terminates at a point 349. The entrance-end windings in the view of FIG. 3*a* are distorted away from their true locations for clarity in describing the winding configuration.

In a similar manner, conductor 316 commences at a point 360 at the entrance end of the yoke and proceeds in a saddle-wound manner to a point 379. From point 379 to point 390 conductor 316 is wound in toroidal fashion about core 312.

The toroidal windings 320–334 occupy a region subtended by a central angle 396 defined between plane 392 and a plane 394 passing through the axis. The saddle windings associated with the half of yoke 310 to the right of vertical plane 393 occupy regions subtended by acute central angles 397 and 398 between planes 392 and 393 and 393 and 394, respectively. The regions and therefore the two types of windings are nonoverlapping or independent.

Figure 3A:
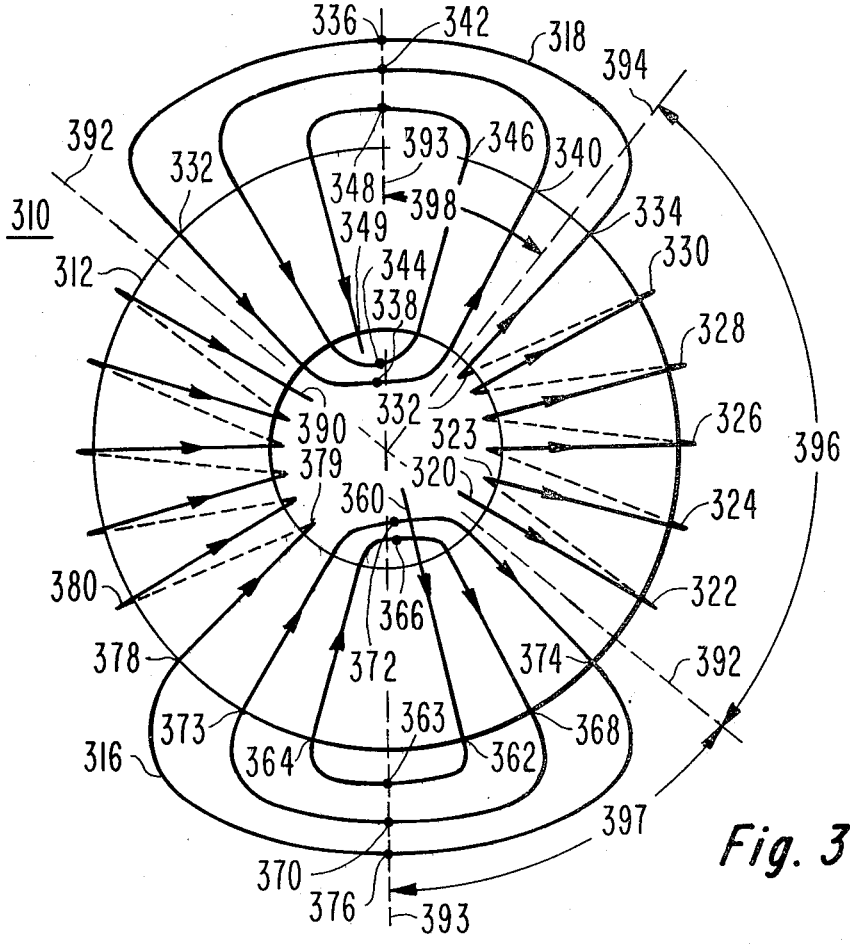
Figure 3C:
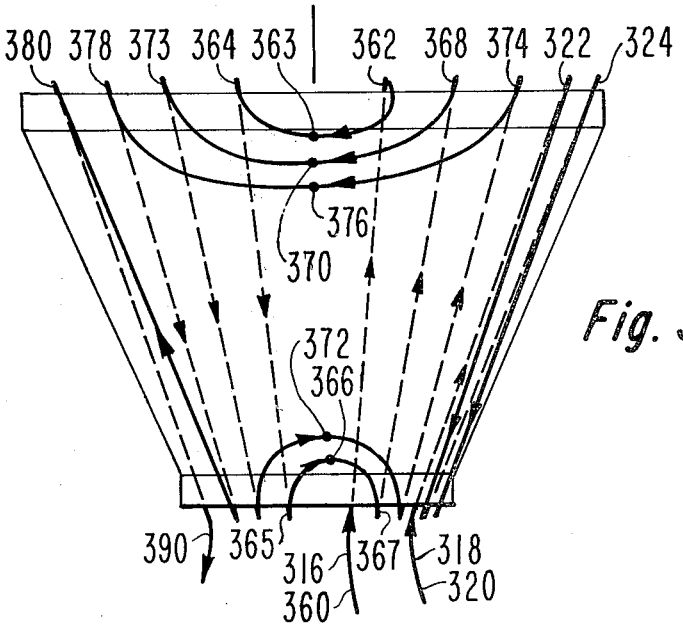
Figure 3B:
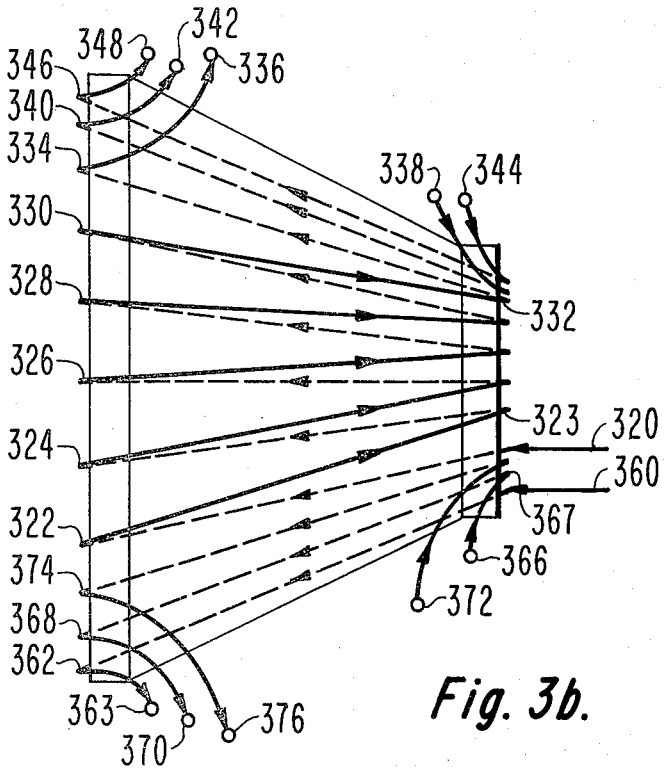
Figure 3D:
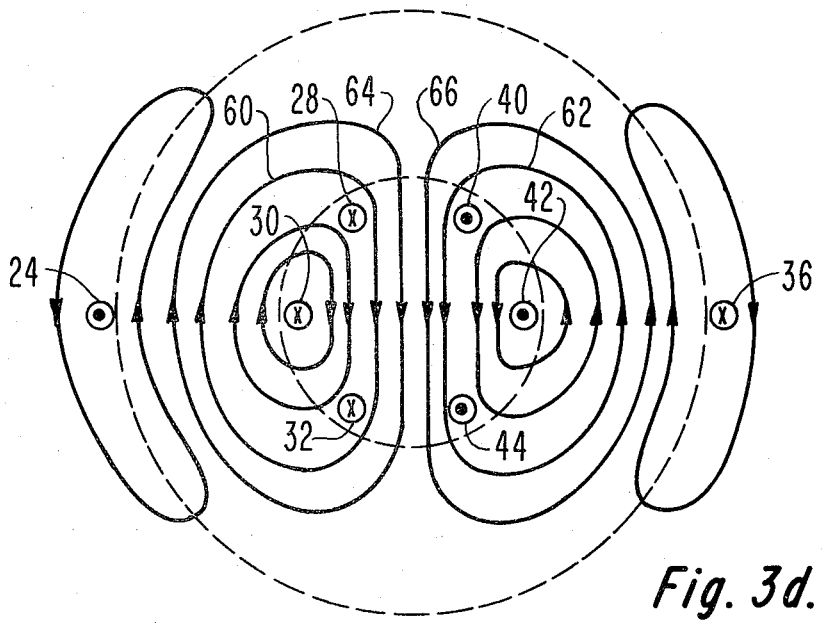

FIG. 3*d* illustrates in cross-section the magnetic field structure generated by an arrangement according to the invention. FIG. 3*d* illustrates a winding structure similar to that illustrated in FIG. 2, and corresponding elements have corresponding reference numbers. FIG. 3*d* as illustrated lacks conductor portions at the top and bottom of the outer periphery of the core, as compared with the arrangement of FIG. 2.

Comparison of FIG. 2 with FIG. 3*d* reveals that magnetic field lines 64 and 66 extending along the outer periphery of the core in FIG. 2 are rerouted to the central aperture in FIG. 3 where they enhance the deflection field, without any detrimental effect due to their absence from the outer periphery. Since the deflection field within central aperture 14 is enhanced, the same amount of beam deflection can be achieved in the arrangement of FIG. 3 with less deflection current than in the arrangement of FIG. 1.

As illustrated in FIG. 3, an abrupt transition is made between the toroidal and saddle-wound portions of the deflection windings. If desired, a gradual transition can also be achieved by alternating toroidal and saddle-wound turns in the transition region. With such an alternating arrangement, the windings continue to be nonoverlapping in that any ray perpendicular to the axis intercepts windings of only one type.

While the described arrangement may be advantageous in reducing the leakage field associated with the deflection winding, it may also be arranged to reduce the conductor length required for the winding. For example, a toroidal turn requires a return winding having a length exceeding the axial length of the core, as illustrated by the return winding between points 322 and 323 in FIG. 3*b*. When the average of the sum of the lengths of the entrance and exit-end return saddle windings associated with a forward conductor is less than the length of the toroidal return winding, it is advantageous to switch from toroidal to saddle windings.

For example, exit-end return winding 362-363-364 and entrance-end return winding 365-366-367 each serve to return one inner-surface conductor. When the sum of the lengths of exit-end return conductor 362-363-364 and entrance-end return conductor 365-366-367 is less than twice the length of a toroidal return conductor, less conductor length is required for saddle turns at that location compared with toroidal turns.

What is claimed is:

1. A deflection yoke adapted for deflection of an electron beam of a kinescope, comprising:

deflection winding means including first and second winding portions lying along the inner surface of a magnetically permeable annular core in a nonoverlapping manner for producing a field upon the passage of a deflection current therethrough for deflecting the electron beam to form a line, said winding means further comprising first return conductors disposed at the entrance and exit ends of said core and associated with said first winding portions to form saddle windings, said winding means also comprising second return conductors girdling said core and associated with said second winding portions to form toroidal windings.

2. A deflection yoke adapted for deflection of an electron beam of a television picture tube, comprising:

first and second deflection winding portions disposed inside a toroidal magnetic core for producing a deflection field for deflecting the electron beam to form a line, said first deflection winding portion further comprising return conductors disposed near the electron beam entrance and exit ends of said core to form saddle windings occupying a region subtended by a first control angle, said second deflection winding portion further comprising return conductors girdling said core to form toroidal windings occupying a region subtended by a second central angle independent of said first central angle.

* * * * *